US005653031A

United States Patent [19]

Richter

[11] Patent Number: 5,653,031

[45] Date of Patent: Aug. 5, 1997

[54] SAFETY BELT CUTTER

[76] Inventor: Herbert Richter, Drosselweg 8, 75331 Engelsbrand, Germany

[21] Appl. No.: 697,613

[22] Filed: Aug. 28, 1996

[51] Int. Cl.[6] ..... B26B 3/00

[52] U.S. Cl. ..... 30/294; 30/280

[58] Field of Search ..... 30/278, 280, 286, 30/289, 290, 294

[56] References Cited

U.S. PATENT DOCUMENTS

| | | | |
|---|---|---|---|
| 3,639,983 | 2/1972 | Knipfing | 30/294 |
| 4,134,206 | 1/1979 | Beermann | 30/294 |
| 4,385,440 | 5/1983 | Webb | 30/294 |
| 4,510,688 | 4/1985 | White | 30/294 |
| 4,581,823 | 4/1986 | Gilman | 30/280 |
| 5,007,171 | 4/1991 | Horning, Jr. | 30/294 |
| 5,395,136 | 3/1995 | Buchner | 30/294 X |

FOREIGN PATENT DOCUMENTS

| | | | |
|---|---|---|---|
| 0 122 311 | 10/1984 | European Pat. Off. | 30/280 |
| 2 165 791 | 4/1986 | United Kingdom | 30/294 |

*Primary Examiner*—Hwei-Siu Payer
*Attorney, Agent, or Firm*—Klaus J. Bach

[57] ABSTRACT

In a safety belt cutter comprising a housing to be mounted on a safety belt an operating element is provided so as to be movable across the safety belt and has an at least partially U-shaped portion having legs extending essentially parallel to the plane of the belt so as to form a belt-receiving gap wherein a cutting blade with a cutting edge is so mounted that the cutting edge of the blade extends through the gap at an angle to the plane of the belt and is exposed only within the gap of the operating element so that the safety belt is guided within the gap onto the cutting edge so as to be severed if, after an accident, the operating element is moved across the safety belt.

11 Claims, 3 Drawing Sheets

SAFETY BELT CUTTER

BACKGROUND OF THE INVENTION

The present invention relates to a device for cutting a safety or seat belt in an emergency when the safety belt cannot be released for some reason.

Seat belts are used particularly in motor vehicles and in airplanes for fastening the occupants on their seats. They consist of a belt of an inelastic high-strength material and restrain the occupants of a seats so as to prevent the occupants from impacting on vehicle interior components during an accident.

A seat belt is closed or opened by means of a belt knuckle which is mounted to the seat or to the vehicle floor and includes generally a plug-in lock and a push bottom release. It is possible however, that during an accident the vehicle body is deformed such that the knuckle release cannot be reached by the vehicle occupant and the seat belt can therefore not be released. It is also possible that the belt knuckle is damaged during an accident such that the release mechanism becomes jammed which also prevents the release of the seat belt. If the seat belt cannot be released for any reason the respective occupant is captured by the seat belt. This may lead to dangerous situations as, after an accident, it is often important that the vehicle occupants rapidly leave the vehicle or can be rapidly taken out of the vehicle. In order to be released from a seat belt when the seat belt knuckle cannot be opened, it is generally necessary to cut the seat belt. However, since a knife or scissors are often not available for that purpose, it has been proposed to arrange a cutting device somewhere reachably in the interior of the vehicle so that the belt can be cut in an emergency. However, such cutting devices are often unreachable after an accident because, as a result of the accident, the occupant strapped into his seat cannot reach the cutting device or the cutting device has been displaced by the accident and is no longer in a reachable place. The use of such a cutting device under high-stress accident conditions however is somewhat problematic since such a cutting device has to be used carefully to avoid injuries to the occupant. However, since in the hectic of an accident, the required care cannot always be taken, the use of such cutting devices may easily lead to injuries of a vehicle occupant.

German OS 28 41 404 discloses a safety belt cutting device for automobiles which includes a housing to be mounted on the safety belt. The housing has a top and a bottom part with a passage fomed therebetween through which the safety belt extends. A blade carrier is slidably supported in the upper housing part with a belt cutting blade projecting therefrom at one end thereof into a slot formed in the lower housing part such that the blade cuts the belt apart if the blade carrier is pulled out of the housing by an operating ring attached to the other end of the blade carrier. After the blade carrier is pulled out of the housing the blade is exposed and care must be taken that no injuries are inflicted to any occupants of the vehicle as those blades have to be and are raser sharp.

German UM G 82 23 436.1 discloses a similar arrangement wherein the housing however is monted on the seat belt at an angle to the longitudinal direction of the seat belt whereby the belt is cut at an angle when the blade carrier is pulled out of the housing. In this case the blade carrier can not be pulled fully out of the housing so that the blade is not exposed after the seat belt is cut and can not cause any injuries to the occupants of the vehicle. Then of course it is not possible to use the blade to cut loose other passengers who, after an accident, might be unable to free themselves from their safety belts.

EP 0 608 467 A1 discloses a safety belt system for automobiles wherein a cutting device is mounted on the belt so that the belt can be cut during an emergency to release an occupant restrained by the belt. In column 1, line 37 reference is made to DE-OS 28 41 404 and it is said in column 2, lines 14–36 that, at one side of the cutting blade, the cutting device disclosed therein is firmly mounted onto the safety belt so that the belt will not be properly released if the device is not correctly mounted onto the belt. In the device of EP 0 608 467 A1 the belt cutting device is therefore firmly mounted centrally onto the belt and two cutting blades are provided, one at each side of the central mounting area of the device. Then the belt is cut at the opposite ends of the belt area which is engaged by the cutting device and the belt is fully cut loose from the device when it is cut during an emergency. However also in this case, the blades are exposed after cutting and might cause injuries to the occupants after they have been used to cut a seat belt during an accident.

It is the object of the present invention to provide a safety belt cutter which is always easily accessible and which can be utilized to free not only the occupant on whose seat belt the cutting device is mounted but also other vehicle occupants in a simple manner and without risks of injuries to the vehicle occupants.

SUMMARY OF THE INVENTION

In a safety belt cutter comprising a housing to be mounted on a safety belt an operating element is provided so as to be movable across the safety belt and has an at least partially U-shaped portion having legs extending essentially parallel to the plane of the belt so as to form a belt-receiving gap wherein a cutting blade with a cutting edge is so mounted that the cutting edge of the blade extends through the gap at an angle to the plane of the belt and is exposed only within the gap of the operating element so that the safety belt is guided within the gap onto the cutting edge so as to be severed if, after an accident, the operating element is moved across the safety belt.

The safety belt cutter according to the invention remains at a predetermined location with respect to the occupant, no matter how much the vehicle is deformed during an accident. Since the cutter is already properly positioned for cutting the seat belt it only needs to be operated for cutting the seat belt. It is not necessary to search for a cutting device and, after its retrieval, to properly place it onto the belt so that the belt can be cut. After having himself or herself freed the occupant can use the cutting element to cut free other occupants without any danger of injuring himself or herself or the othe occupants. The ready availability of the safety or seat belt cutter according to the invention for use without any additional measures, without mental adjustment, without the need to see the cutting device or the area where the belt is to be cut and even without having to be afraid to cause injuries saves valuable time. This is particularly important where, for saving the life of an accident victim, every second counts as is often the case.

Since with the belt cutter according to the invention an accident victim cannot be injured when the belt cutter is operated it is not necessary to use any particular precautions, that is, the cutting device according to the invention can be operated in an emergency without the need for considering the circumstances.

By using for the cutting element a blade greatly facilitates the manufacture of the cutter as a blade can be manufactured in a simple manner and at very low cost. In addition, a blade can be easily mounted in the operating element.

By providing the cutting edge of the blade between the legs of the U at an angle to the legs which extend parallel to the plane of the belt, the cutting edge for cutting the belt is maintained at an optimal position with respect to the belt. During operation of the cutting device the belt is guided into the wedge-shaped opening which is formed by one leg of the U and the cutting edge of the blade. Preferably the U-legs are spaced by an amount corresponding about to the thickness of the belt and they are sufficiently wide to to hold the blade at a proper cuttung angle even if the blade holder is used to cut another belt when it is not guided by the cutter housing.

It is also quite advantageous if the operating element is slidably supported in a seat belt cutter housing and has an operating handle projecting from the housing so that it can be readily used.

Such an arrangement has the advantage that the belt is not damaged when the housing is subjected to pulling forces. Only if pulling forces are applied to the operating handle is the cutting process initiated. Further, with the arrangement according to the invention, the operating element can be used, after it has been pulled out of the cutter housing and has cut thereby the belt onto which the belt cutter has been mounted, to safely cut other seat belts which are not provided with the seat belt cutter according to the invention or the wearers of which are not in a position after an accident to cut their seat belt themselves. Upon pulling the operating handle from the belt cutter, the belt is cut and the seat occupant is freed. After the occupant has freed him or herself in this manner, the occupant, now having the cutting element in his or her hand, can cut the seat belts of the other occupants without fear to injure the other occupants.

In the arrangement according to the invention, the operating element is preferably provided with a recess into which a projection formed on the lower part of the housing extends. In this manner, the operating element is secured in place by such a safety mechanism such that unintentional pulling of the operating element out of the housing is prevented. The force required for pulling the operating element out of the housing, that is, the force needed to overcome the safety mechanism depends on the shape and depth of the recess, that is, the projection extending from the lower housing part into the recess. If the projection is provided with edges and is relatively deep the force necessary to pull the cutting element out of the cutter housing is larger than if the projection is rounded and does not extend deeply into the recess.

Even though it is particularly advantageous if the operating element has the shape of a rod so that it can be pulled out of the housing by linear movement the cutting edge may be so arranged in a housing that when operated the cutter follows a circular path and cuts the belt in this manner. In this case, a pull cable may be provided as the operating element which, by suitable means, causes the cutting edge to move along a circular path through the belt. execute a rotation. The cutting edge could further have the shape of a rectangular triangle wherein the cutting edge is formed by the hypotenuse and the cutting is effected by pressure onto a short side of the triangle. With such an arrangement, the operating element is formed as a push button projecting from the housing. The operating element could also be a rotary button by means of which the cutting edge is moved through the belt for cutting the belt.

In another embodiment of the invention, the housing comprises a plate-like bottom part and a plate-like top part which is mounted onto the bottom part with the seat belt extending through the housing between the bottom and the top parts in a direction normal to the sliding direction of the operating element in the housing. The slidable operating element projects at one end from the housing and is provided outside the housing with a pull handle. Such a cutter is, on one hand, easy to manufacture and, in addition, has an attractive shape. The attractive flat shape has also the advantage that the belt cutter does not disturb the vehicle occupants even if it is permanently attached to the belt, in fact, that it is hardly noticed as an accessory part.

In an advantageous embodiment, the lower housing part has belt clips which extend parallel to the lower housing part an in spaced relationship therefrom; the belt extending between the belt clips and the lower housing part plane. The belt clips have raised extensions which are abutted by the housing top part whereby the belt clips are bent toward the housing bottom part for engaging the belt. Preferably, the belt clips have pointed projections at their side adjacent the belt for engagement with the belt when the housing bottom and top parts are firmly joined. The belt is then bent over the pointed projections of the clips which thereby engage the belt.

With the belt clips, belts of any commercially available size can easily be inserted into the housing. The clips also insure that the belt is properly positioned within the housing. When the housing top is secured to the housing bottom the clip extensions are engaged and the clips are pressed onto the belt so that the housing is firmly held in position on the belt. In this manner, the belt cutter is securely held in place on the belt. Since the clips have pointed projection at their sides adjacent the belt, sliding of the belt cutter along the belt is prevented. Of course, the projections must be so shaped that they do not damage the belt. Instead of projections, the clips may have rubberized surfaces adjacent the belt which would also prevent sliding of the belt cutter along the belt.

It is further advantageous if the cutter comprises a blade with a cutting edge disposed in a housing which consists of a bottom and a top part and through which the belt extends and is firmly retained therein such that the cutting edge extends at an angle with respect to the plane of the belt. Such an arrangement is relatively inexpensive to manufacture since it does not require a separate operating element in which the blade is mounted. It is particularly advantageous if the housing can be opened and the upper part is attached to the lower part at the edge opposite the blade by means of a molded hinge. This makes mounting of the belt cutter onto the belt particularly easy.

To prevent unintended use of such a cutter, the upper housing part may have a projection which is disposed between the cutting edge and the belt and which extends up to the bottom part of the housing. The projection includes a predetermined breaking point so that it can be broken off the housing top part if the cutter needs to be operated. The projection however, prevents unintended use of the cutter and damage to the belt by such unintended use. Only if a force is applied which is sufficient to break away the projection can the seat belt be cut by the belt cutter.

To prevent the cutter from moving off the cutting path the housing bottom part may have projections which project toward the belt and extend in a transverse direction with respect to the belt and which form guide walls for the blade carrier. Also, the upper housing part may have rubberized areas with such high friction that the belt is firmly held in position.

Further features of the invention will be described below on the basis of the accompanying drawings showing two particular embodiments of the invention.

DESCRIPTION OF PREFERRED EMBODIMENTS

Figure 1A:
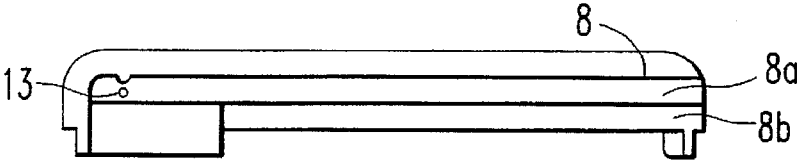
FIGS. 1*a* to 1*e* show the various components of the seat belt cutter according to the invention.
Figure 1B:
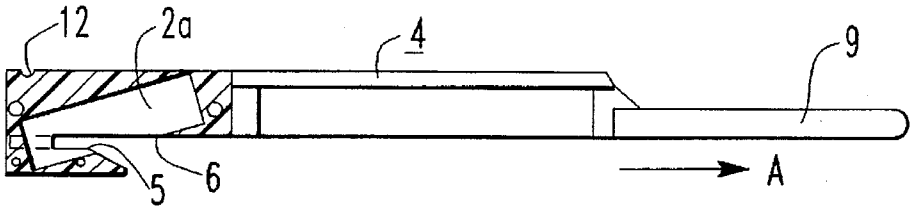
Figure 1C:
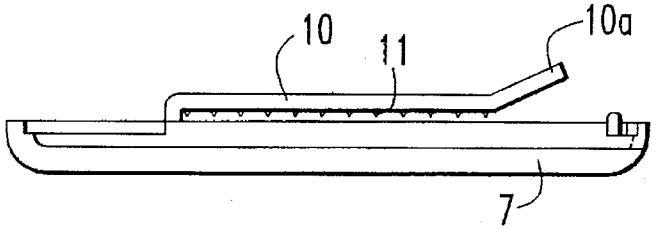
Figure 1D:
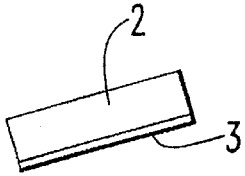
Figure 1E:
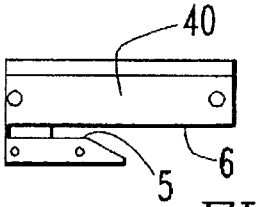
Figure 2:
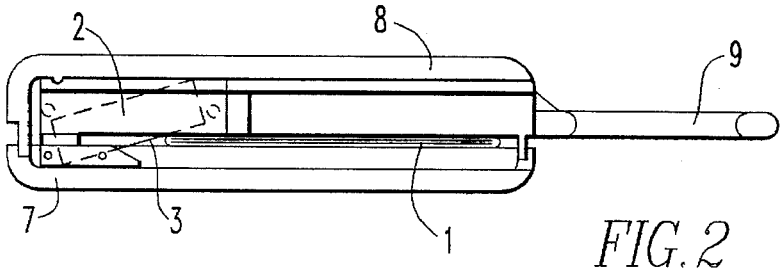
FIG. 2 is a side view of the seat belt cutter in an assembled slot.
Figure 3:
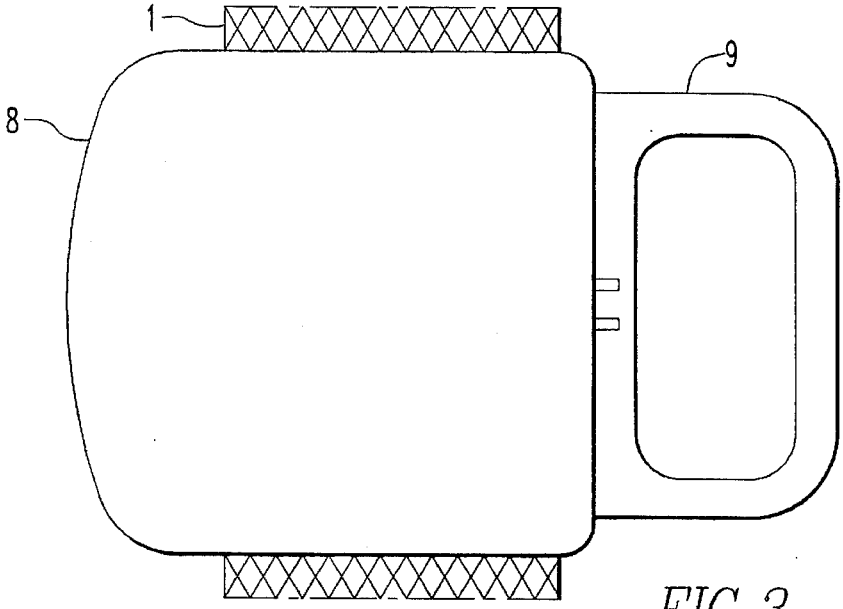
FIG. 3 is a top view of the seat belt cutter.
Figure 4:
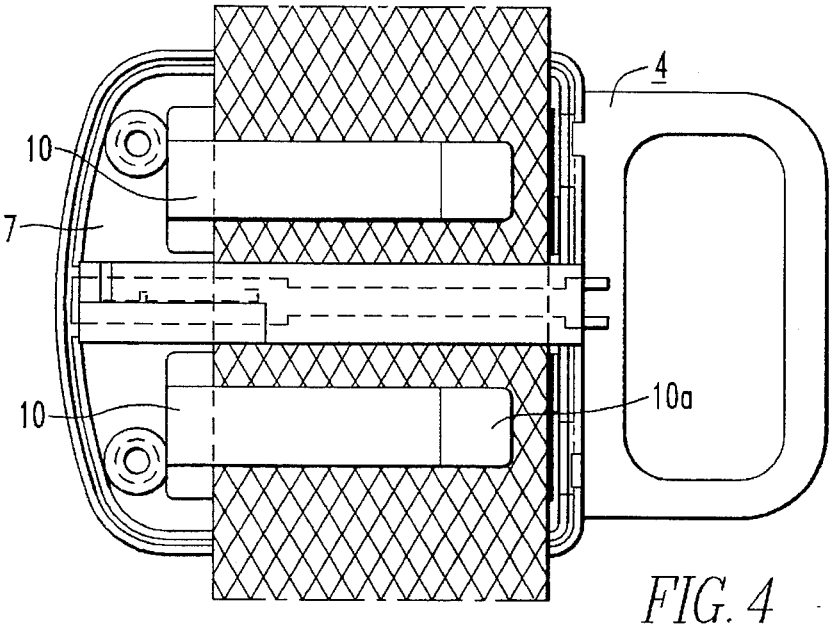
FIG. 4 is a top view of the lower housing part of the seat belt cutter with the seat belt disposed therein.

In a first embodiment of the invention as shown in FIGS. 1*a* –1*e* and 2 to 4 the seat belt cutter comprises a lower housing part 7 and an upper housing part 8. The upper housing part 8 includes a guide track 8*a*, 8*b* which is formed into the upper housing part 8 as a groove with T-shaped cross-section. An operating element 4 with a T-shaped cross-section is slidably received in the T-shaped groove 8*a*, 8*b*. The operating element 4 has a handle 9 at its end outside the housing for pulling the operating element out of the housing. The upper housing part 8 has at one end, within the guide track 8*a*, 8*b*, a projection 13 which is received in a cavity 12 formed in the operating element 4 to retain the operating element in place within the housing.

At its end opposite the handle 9, the operating element 4 includes a U-shaped portion formed by two legs 5, 6. A blade 2 with a cutting edge 3 is disposed within a recess 2*a* formed in the operating element 4 such that the cutting edge 3 of the blade 2 extends through the U-shaped portion in an inclined position with respect to the legs 5, 6 defining the U-shaped portion. For mounting the blade 2 on the operating element 4, a cover 4*a* is provided which, after placement of the blade 2 into the recess 2*a*, is mounted onto the operating element 4. The cover 4*a* has a shape adapted to the shape of the end portion of the operating element 4. The cover 4*a* can be mounted onto the operating element 4 in any suitable manner, for example, by screwing, by riveting or by cementing. The U-legs are spaced from one another so as to provide a gap corresponding to the thickness of the belt, that is, the gap should be slightly larger than the thickness of the belt so that the belt can enter the gap. At its entrance end the gap is widened to facilitate catching of a belt. Also the operating element, and, together therewith the gap has a width in the longitudinal direction of the belt which is sufficient to provide guidance for the operating element such that the blade is maintained essentially normal to the plane of the belt even if the operating element is used to cut another occupants belt. Preferably the width of the operating element at the U-shped end is in the longitudinal direction of the belt is at least twice width of the gap formed between the U-legs.

The bottom part 7 of the housing includes clips 10 which extend in spaced relationship parallel to the opening plane of the bottom housing part 7. The clips 10 have upwardly projecting extensions 10*a* which are engaged by the upper housing part 7 when the housing is assembled. In this manner, the clips 10 are pressed downwardly onto the housing bottom part 7 and into firm engagement with a section of the seat belt 1 disposed below the clips 10 whereby the seat belt cutter is retained in a particular position on the seat belt 1. For improved engagement with the belt 1, the clips may have spikes 11 extending from their bottom surfaces toward the bottom housing part and firmly grasping the seat belt when the housing top and bottom parts are joined.

If now, the handle 9 of the operating element 4 is pulled in the direction of the arrow A (FIG. 1*b*, FIG. 2, FIG. 3, FIG. 4) the operating element 4 slides in the T-shaped track 8*a*, 8*b* out of the housing 7, 8. The belt is guided in the process into the gap between the legs 5, 6 at the U-shaped end of the operating element 4 where it is engaged by the cutting edge 3 of the blade 2 and is cut apart. When the operating element 4 is fully pulled out of the housing the belt 1 is completely severed.

Figure 5:
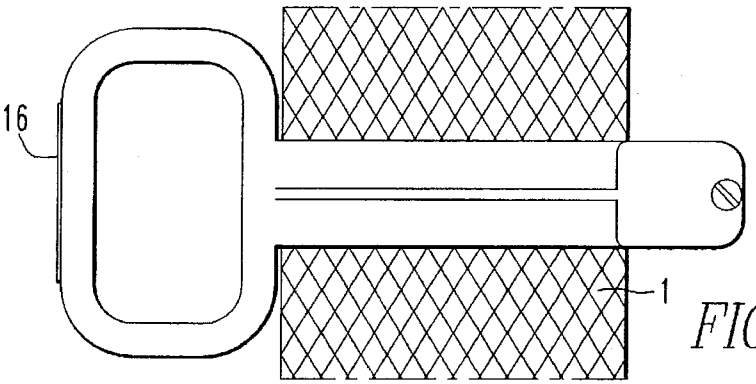
FIG. 5 shows anothe embodiment of a seat belt cutter.
Figure 6:
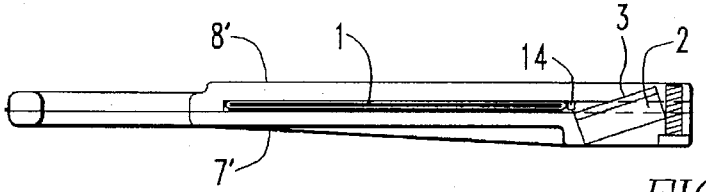
FIG. 6 is a cross-sectional side view of the seat belt cutter as shown in FIG. 5.
Figure 7:
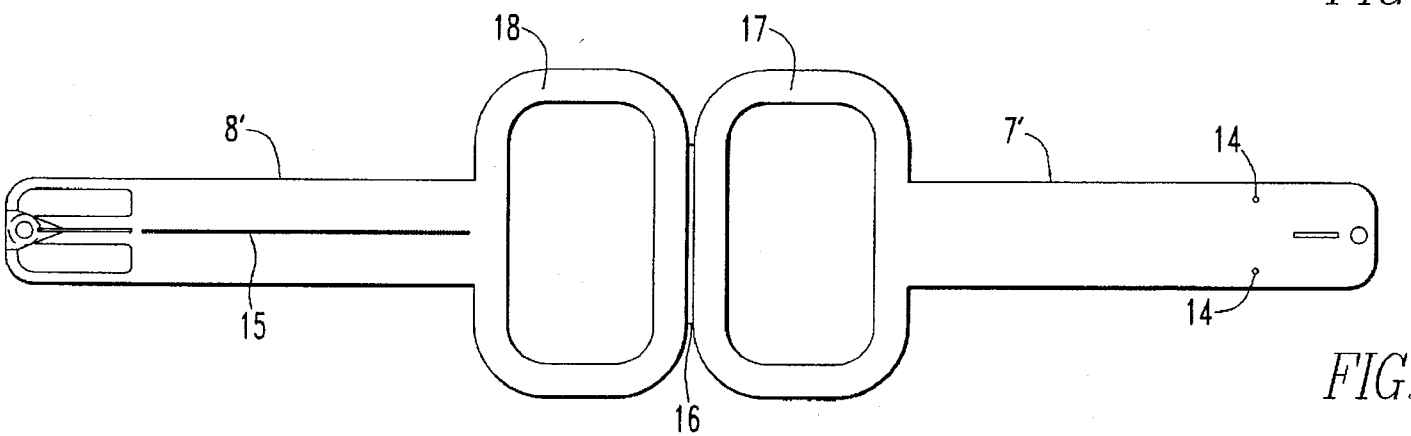
FIG. 7 shows the cutter of FIGS. 5 and 6 opened up.
Figure 8:
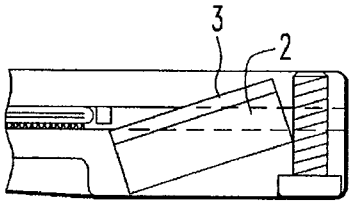
FIG. 8 is an enlarged view of part of FIG. 6 showing the cutting blade disposed in the cutter.

A particularly simple embodiment for a seat belt cutter is shown in FIGS. 5 to 8. Identical parts of FIGS. 1*a*–1*e* and 2 to 4 are identified in FIGS. 5 to 8 by the same reference numerals.

As shown in FIGS. 5 to 8, the seat belt cutter comprises a housing 7', 8' consisting of a housing bottom part 7' and a housing top part 8'. The housing bottom and top parts 7', 8' are essentially clip-shaped. At one end, the housing bottom and top parts 7', 8' are widened to form openings 17, 18. The openings 17, 18 that are the widened ends of the housing parts 7', 8' are so shaped that, together, they form a handle portion. At the outer ends of the handle portion the top and bottom parts 7', 8' are joined by a hinge portion 16. At the opposite end, the top part 8' has an increased width wherein a blade 2 with a cutting edge 3 is arranged. The blade 2 is so arranged in the top part 8' that the cutting edge 3 extends at an angle to the plane of the top part 8' of the belt cutter housing.

For mounting the belt cutter to a belt 1, the belt 1 is placed onto the bottom part 7' and the top part 8' is flipped about the hinge 16 onto the bottom part 7'. Then the belt 1 is disposed between the bottom and top parts 7', 8' and between the handle end and the increased thickness end of the cutter top part 8'. To prevent displacement upon mounting of the belt cutter onto a belt, the upper housing part 8' is provided with spikes 15 which project from the plane of the housing top part 8' toward the housing bottom part 7' and transverse to the direction in which the belt 1 extends through the housing top and bottom parts 7'8' and which firmly engage the belt when the housing top and bottom parts 8' 7' are mounted together.

To prevent unintended cutting of the seat belt the housing bottom part 7' includes projections 14 which extend about to the housing top part 8' when the housing top and bottom parts 8' and 7' are joined and which are arranged between the blade 2 and the belt 1. The projections 14 are connected to the bottom housing part 7' by means of a predetermined breaking point structure.

For cutting the belt 1, a pulling force must be applied to the handle 17, 18 of the housing 7', 8' which is large enough that the projections 14 break off at the predetermined breaking point; then the blade 2 can cut the belt 1 without further impediments.

What is claimed is:

1. A safety belt cutter comprising a housing for receiving a safety belt therein and including an operating element slideably supported in said housing so as to be movable across said safety belt and having a handle portion integrally formed therewith and projecting from said housing and an at least partially U-shaped portion with legs extending essentially parallel to the plane of said belt and being spaced from each other to form a belt-receiving gap, and a cutting blade with a cutting edge so mounted on said operating element that said cutting edge extends through said gap at an angle to the plane of said belt and is exposed only within said gap between the legs of said U-shaped portion of said operating element so that said safety belt is guided within said gap onto said cutting edge to be severed thereby if, after an accident, said operating element is moved across said safety belt.

2. A safety belt cutter according to claim 1, wherein said operating element has, at its U-shaped portion, a width in the direction normal to the plane in which said blade is disposed which is greater than the width of said gap between the legs of said U-shaped portion so that said safety belt is properly guided between said legs.

3. A safety belt cutter according to claim 2, wherein said U-shaped portion of said operating element has a width of at least twice the width of the gap between said legs.

4. A safety belt cutter according to claim 2, wherein said operating element has a recess and said housing has a projection extending into said recess for retaining said operating element in said housing.

5. A safety belt cutter according to claim 2, wherein said housing consists of plate-like bottom and top parts between which said belt is received and through which said belt extends transverse to the direction in which said operating element is slidably supported in said housing.

6. A safety belt cutter according to claim 5, wherein said housing bottom part includes spaced clips extending parallel to the plane in which the housing bottom part is disposed and said belt is disposed between said clips and said housing bottom part, each of said clips having an extension which is engaged by the housing top part when said housing top part is mounted onto said housing bottom part so as to firmly engage said clips with said belt.

7. A safety belt cutter according to claim 6, wherein said clips have spikes projecting from their sides adjacent said belt.

8. A safety belt cutter comprising a housing for receiving a safety belt therein and being slideably supported on said safety belt and having a handle integrally formed therewith and projecting therefrom, said housing having a bottom part and a top part between which said belt is disposed and which together form at one end a U-shaped portion with legs defining a gap in which a cutting blade with a cutting edge is so disposed in said housing that said cutting edge extends at an angle to the plane of said belt and is exposed only within said gap between the legs of said U-shaped portion of said housing so that said safety belt is guided within said gap onto said cutting edge to be severed thereby if, after an accident, said belt cutter is moved across said safety belt, one of said housing parts having at least on projection which is disposed between said cutting edge and said belt and which extends toward the other housing part, said projection having a break point structure such that said cutting edge can sever said belt only after said projection is broken off.

9. A safety belt cutter according to claim 8, wherein said housing top and bottom parts are joined by a hinge at their ends remote from said blade.

10. A safety belt cutter according to 9, wherein at their ends remote from said blade, said housing top and bottom parts have handle portions which together form said handle and said hinge is a web interconnecting said top and bottom parts.

11. A safety belt cutter according to claim 8, wherein said top part has spikes which project toward said belt and are arranged in a direction transverse to said belt for retaining said cutter in position on said belt.

* * * * *